United States Patent [19]

Pizzuto

[11] 4,308,743

[45] Jan. 5, 1982

[54] BLANK DEFLECTOR

[76] Inventor: Joseph Pizzuto, 3 Mohawk Dr., Wolcott, Conn. 06716

[21] Appl. No.: 81,036

[22] Filed: Oct. 1, 1979

Related U.S. Application Data

[63] Continuation of Ser. No. 915,824, Jun. 15, 1978, abandoned.

[51] Int. Cl.[3] ..... B21D 45/00

[52] U.S. Cl. ..... 72/345; 10/12 T; 10/11 E; 72/427

[58] Field of Search ..... 72/345, 427; 10/11 E, 10/12 T, 11 T, 72 T, 76 T; 83/158

[56] References Cited

U.S. PATENT DOCUMENTS

| | | | |
|---|---|---|---|
| 3,274,626 | 9/1966 | Meerendonk | 10/12 T |
| 3,276,304 | 9/1966 | Gilbert et al. | 83/158 |
| 3,593,561 | 7/1971 | Roth | 72/427 |

*Primary Examiner*—Leon Gilden

*Attorney, Agent, or Firm*—DeLio and Montgomery

[57] ABSTRACT

A mechanism incorporated in a die forming machine which includes a rotating blade driven in a timed trajectory such that the blade hits a blank, at or about the instant of its discharge from the die, and propels the blank forcibly out of the path of a moving gate in the direction of the blank chute in order to expedite its removal from the working area.

5 Claims, 6 Drawing Figures

BLANK DEFLECTOR

This is a continuation of application Ser. No. 915,824, filed June 15, 1978, now abandoned.

This invention relates to a blank deflecting mechanism which is incorporated in a die forming machine and which includes a rotating blade driven in a timed trajectory such that the blade hits a blank, at or about the instant of its discharge from the die, and propels the blank forcibly in the direction of the blank chute in order to expedite its removal from the working area.

In die forming machines it is customary to rely upon the force of gravity to cause a finished blank, upon its ejection from the final die, to drop into a chute for collection in a bin and/or transfer to another machine. In some instances an air blast has been used to speed up the removal of the blank from the vicinity of the die so that the gate can be operated on a faster cycle, but an air blast is extremely noisy and inherently ineffective where a small heavy metal object such as the workpiece ejected from the die is concerned. The provision of air at high velocity requires air supply means which may be somewhat complicated and which usually generates noise at intolerable levels, e.g., failing to meet OSHA standards.

It is accordingly an object of the present invention to provide a simple, easily adjusted mechanical element which hits each blank at or about the instant it is ejected from the die and positively propels the blank in any desired direction, particularly in the direction of the chute by which it is removed from the machine or at least from the working zone.

It is a further object of the invention to provide a blank deflector wherein the blank contacting element can readily be removed and replaced for adaptation of the deflector to each specific size and shape of blank to be acted on.

It is a still further object of the invention to provide certain improvements in the form, construction and arrangement of the several parts whereby the above-named and other objects may effectively be attained.

The invention accordingly comprises the features of construction, combinations of elements, and arrangement of parts which will be exemplified in the constructions hereinafter set forth, and the scope of the invention will be indicated in the claims.

A practical embodiment of the invention is shown in the accompanying drawings, wherein.

Figure 1:
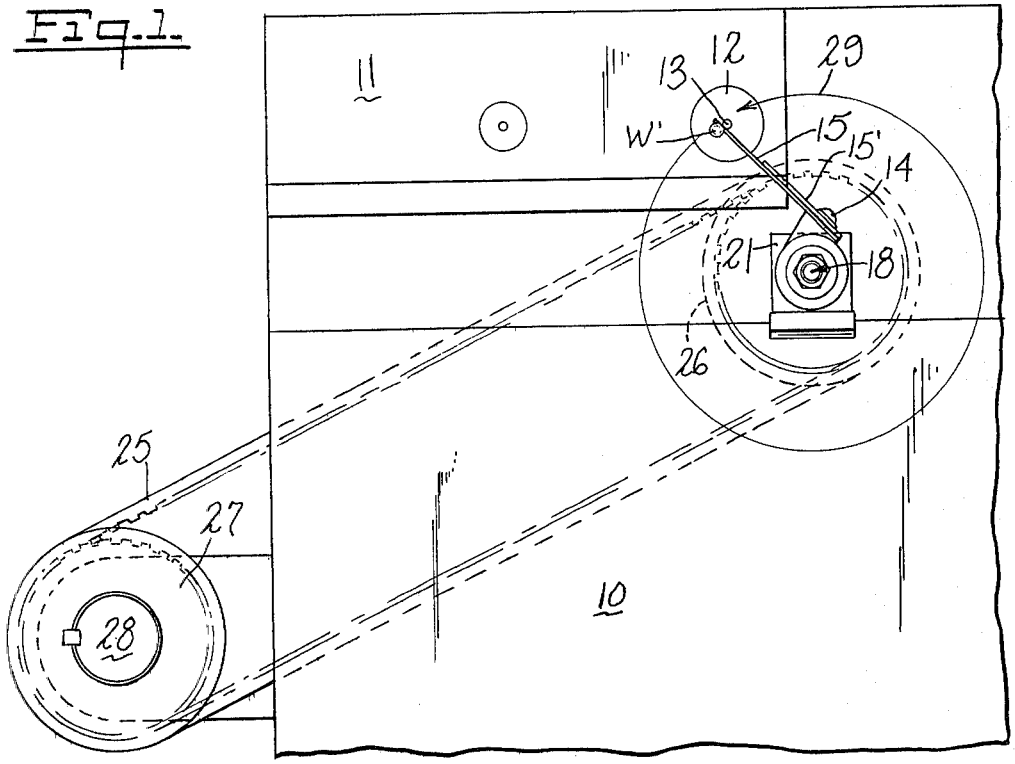
FIG. 1 represents a detail elevation of the die face with the deflector added.
Figure 2:
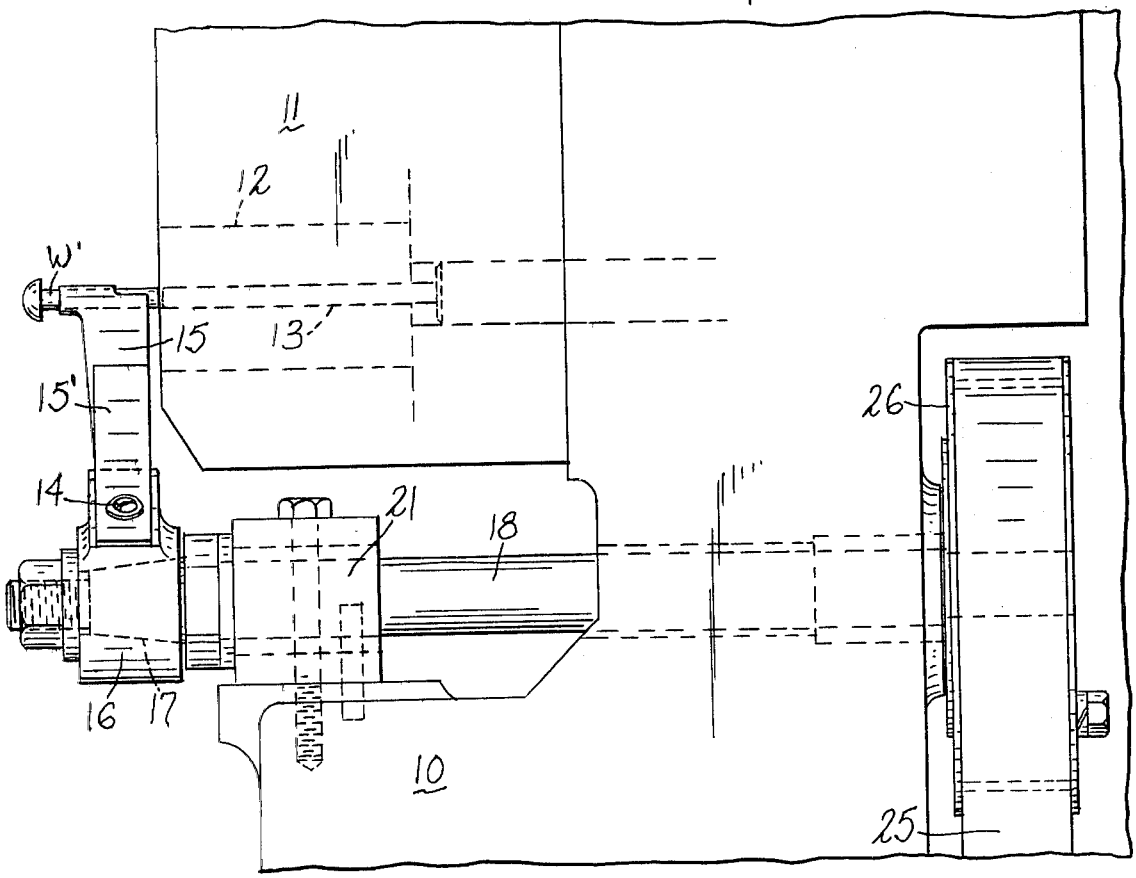
FIG. 2 represents a detail side elevation of the parts shown in FIG. 1.

Referring to the drawings, the base of a die forming machine is indicated at 10, and the die face 11 is provided with a die 12 from which the workpiece W′ is ejected, after forming, by a knockout pin or the like 13. The formed workpiece or blank is represented, for illustrative purposes, as having been headed by the punch and die action.

The deflector is shown in FIGS. 1 to 4 as a flat leaf spring 15 with an enlarged angular head and backed by a reinforcing plate 15′, mounted by means of the screw 14 on the adjustable hub 16, which has a tapered bore to fit on the tapered end 17 of the auxiliary shaft 18. The nut 19 and washer 20 hold the hub on the shaft and permit minute adjustment of its angular position throughout 360°. The auxiliary shaft 18 is journaled in a bearing 21 and driven through a timing belt 24 connecting the auxiliary shaft pulley 26 and the pulley 27. The latter pulley is on the side shaft 28 which is mechanically connected to the driving means for the gate and knockout pins so that the timing of the deflector movement can be accurately synchronized with the ejection of the blank from the die. In the case of the elongated blank W′, shown in FIGS. 1 and 2, it is advantageous to time the rotation of the deflector spring blade (in the direction of the arrow 29) to contact the blank at or just prior to complete knockout; in the latter case the blade may be slightly bent so as to give the blank some added impetus in a downward direction when the knockout is completed. The upper end of a discharge chute, into which the blank is propelled, is indicated at 30 in FIG. 4.

Figure 5:
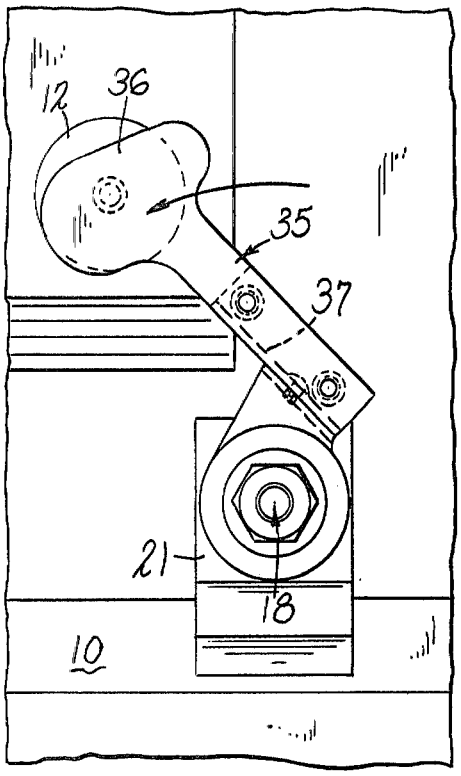
FIG. 5 represents a detail elevation as in FIG. 1 showing a modified form of deflector.
Figure 6:
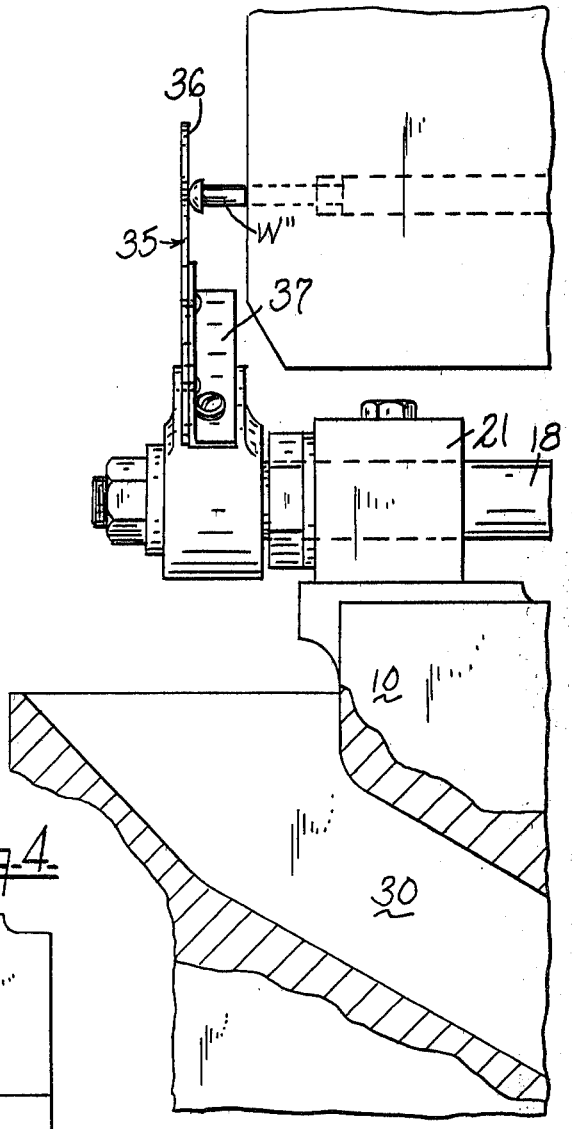
FIG. 6 represents a detail side elevation of the deflector shown in FIG. 5.
Figure 3:
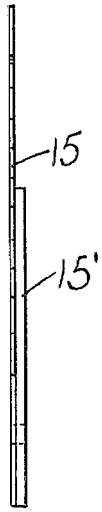
FIGS. 3 and 4 represent edge and flatwise views, on a larger scale, of the deflector blade shown in FIGS. 1 and 2.
Figure 4:
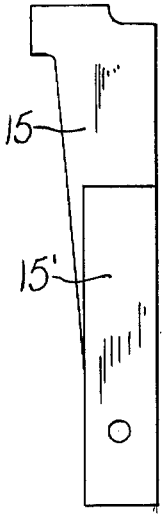

An alternative form of deflector is shown in FIGS. 5 and 6, wherein the deflector is a flat rigid plate 35 having an enlarged head 36 and mounted on the hub 16 through an angle bar 37. This places the deflector in a position to brush against the head of the short blank W″ so that the blank will be urged to drop directly into the chute at the instant of substantially complete knockout.

Other specific forms of deflectors can be provided, if required for differently proportioned blanks. In each case, the deflector and its head are rotated constantly without need for a cam and without high inertia forces. The parts are simple, accessible and easily adjusted or replaced. The trajectory of the deflector is such that it is only briefly in the working area of the punch and die and is entirely out of the way while the punch is acting on the workpiece.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

What I claim is:

1. In a die forming machine having a machine drive and knockout means for ejecting a blank horizontally from the die to drop by gravity toward a receptacle, a blank deflector comprising an elongated blade having a flexible part mounted on a rigid part, a rotating support to which the rigid part of the blade is secured, and timed means for rotating the deflector in a vertical plane along a path which intersects the position of a blank substantially at the moment of its ejection, the blade being past zenith when it reaches said position, whereby the blank's flight downward toward the receptacle is expedited.

2. A blank deflector according to claim 1 which includes a shaft, means for driving the shaft in synchronism with the machine drive, the rotating support being mounted on said shaft, and means for finely adjusting the angular position of the support on the shaft.

3. A blank deflector according to claim 2 wherein the adjusting means include a tapered bore in the support and a matching tapered surface on the shaft.

4. A blank deflector according to claim 1 wherein the blade is a leaf spring so attached to the support that the spring lies in a plane parallel to the axis of rotation of the support.

5. A blank deflector according to claim 1 wherein the blade is a flat plate so attached to the support that the plate lies in a plane perpendicular to the axis of rotation of the support.

* * * * *